United States Patent [19]

Chahvekilian et al.

[11] 4,216,077

[45] Aug. 5, 1980

[54] METHOD OF CRACKING UNDER HYDROGEN PRESSURE FOR THE PRODUCTION OF OLEFINS

[75] Inventors: Edgar Chahvekilian, La Varenne Saint-Hilaire; Rene Brouard, L'Isle-Adam, both of France

[73] Assignee: CECA S.A., Velizy-Villacoublay, France

[21] Appl. No.: 921,909

[22] Filed: Jul. 5, 1978

[30] Foreign Application Priority Data

Jul. 5, 1977 [FR] France ..... 77 20637

[51] Int. Cl.[2] ..... C10G 13/00

[52] U.S. Cl. ..... 208/57; 208/59; 208/61; 208/107

[58] Field of Search ..... 208/57, 59, 61

[56] References Cited

U.S. PATENT DOCUMENTS

| | | | |
|---|---|---|---|
| 2,052,148 | 8/1936 | Ocon | 208/59 |
| 3,720,729 | 3/1973 | Sze et al. | 208/57 |
| 3,730,875 | 5/1973 | Gleim et al. | 208/57 |
| 3,781,195 | 12/1973 | Davis et al. | 208/57 |

FOREIGN PATENT DOCUMENTS

| | | | |
|---|---|---|---|
| 113022 | 12/1975 | German Democratic Rep. | 208/59 |

*Primary Examiner*—Herbert Levine

*Attorney, Agent, or Firm*—Fleit & Jacobson

[57] ABSTRACT

A hydrocarbon feedstock derived from crude oil or other sources is subjected continuously to thermal cracking under pressure and in the presence of hydrogen in order to convert the feedstock to products of lower molecular weight containing high proportions of olefinic components. In a first processing step, a catalytic hydrogenating pretreatment is performed at a temperature within the range of 300° C. to 600° C. and under a pressure within the range of 12 to 85 bars. In a second step, a thermal cracking treatment is performed under a pressure within the range of 10 to 70 bars with residence times of less than 0.5 second and at a temperature within the range of 625° C. to 1,000° C., the quantity of hydrogen employed being such that the molar concentration in the effluents is at least equal to 20%.

5 Claims, 1 Drawing Figure

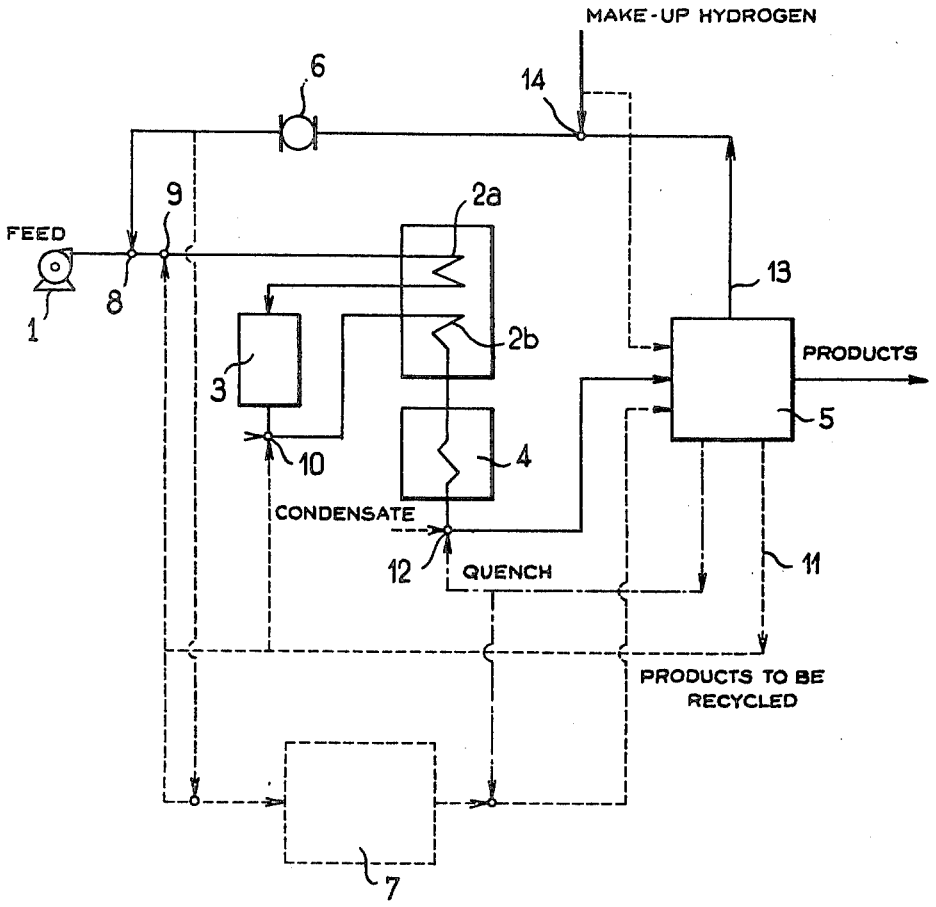
MAKE-UP HYDROGEN
6
14
9
2a
FEED
13
8
1
2b
PRODUCTS
3
5
10
4
CONDENSATE
12
QUENCH
11
PRODUCTS TO BE RECYCLED
7

METHOD OF CRACKING UNDER HYDROGEN PRESSURE FOR THE PRODUCTION OF OLEFINS

This invention relates to a process of production of olefins by thermal cracking of hydrocarbons under pressure and in the presence of hydrogen, which constitutes an improvement of French patent No. 2,164,450 completed by Certificate of Addition No. 2,209,869.

The process described in these patents (hereinafter designated as hydropyrolysis) essentially consists in employing the hydrogen as diluent and operating under a pressure within the range of 10 to 70 bars at a temperature within the range of 625° to 1000° C. with a residence time of less than 0.5 second. By utilizing high cracking temperatures in conjunction with very short residence times, this method makes it possible to obtain direct conversions and, above all, particularly high ultimate yields of light olefins from all distillable hydrocarbon feedstocks, whether these latter are derived from crude oil or other sources.

Another important advantage of this hydropyrolysis process arises from the specific action of hydrogen under the conditions proposed and lies in the appreciable attenuation to the troublesome side reactions which are inherent to any thermal cracking process, from polymerization and decomposition of the deposition of carbon or so-called "coking". The result thereby achieved is that raw materials which exhibit a marked tendency to coke (i.e. heavy feedstocks) offer possibilities of cracking under much less arduous conditions and with much higher yields that is the case with conventional processes.

It is nevertheless a well-known fact that, even when they are attenuated, these undesirable side reactions always show a tendency in the long run to increase above a certain degree of cracking severity, that is to say above certain levels of temperature and/or residence time. In the field of production of olefins, however, it can be stated as a general rule that cracking efficiencies are widely dependent on severity. When one seeks to improve these efficiencies, a limitation is therefore inevitably met by an increased coking tendency at high temperature.

In practice, the limiting temperatures are usually lower as the feedstock is heavier and has a higher end point of distillation.

The present Applicant has found that it is possible to overcome this disadvantage to a large extent and consequently to achieve an even greater reduction in coke formation by associating with the hydropyrolysis treatment a hydrogenating pretreatment which is preferably a catalytic process. The object of this pretreatment is to bring on a favorable modification of the molecular structures of certain heavy components which results in a general lightening of the feedstock and in the widening of its distillation range.

A further object of this pretreatment is to perform at the same time the desulphurization of the feedstock when this latter contains proportions of sulphur which are considered objectionable.

The possibility which is thus afforded constitutes a further important advantage of the pretreatment which is proposed because desulphurization is usually limited under the cracking conditions which characterize the hydropyrolysis process and may not prove sufficient to ensure the qualities desired for the heavy cracked products, especially in the case of heavy feedstocks having high sulphur contents.

The present invention is consequently directed to an improvement in the hydropyrolysis process as described in the patents cited earlier, in the performances of said process and in the quality of the products obtained, especially when the raw materials employed contain hydrocarbons which have a very high boiling point and/or contain objectionably high proportions of sulphurized products.

In more precise terms, said improvement consists in subjecting the feedstock prior to the hydropyrolysis operation proper to a catalytic hydrogenating pretreatment at a lower temperature, the effect of which is on the one hand to produce a modification of certain molecular structures and a general lightening (hydrogenation, partial hydrocracking and so forth) which are conducive to the hydropyrolysis, especially as coking is concerned, and therefore prove all the more advantageous as the feedstock is heavier and, on the other hand, in the case of feedstocks having high sulphur contents, the desulphurization can attain high levels.

This process is therefore characterized by the association of two consecutive steps:

(a) a catalytic hydrogenating pretreatment at a temperature within the range of 300° to 600° C. and under a pressure within the range of 12 to 85 bars in order to modify the molecular structures and/or desulphurize the feedstock, which precedes the following step without any discontinuity.

(b) a thermal hydrocracking treatment proper (hydropyrolysis) performed under a pressure within the range of 10 to 70 bars, residence times of less than 0.5 second and at a temperature within the range of 625° to 1000° C., the quantity of hydrogen employed being such that its molar concentration in the effluent is at least equal to 20%.

This association of hydrogenating pretreatment plus hydropyrolysis results in the following advantages:

substantial attenuation of coke formation at a given cracking severity;

the resultant possibility of increasing the cracking severity and consequently of improving the conversion into useful products without any hindrance;

in the case of feedstocks containing high proportions of sulphur, the possibility of desulphurization prior to hydropyrolysis thus improving the characteristics of the cracked products obtained, especially in regard to heavy products.

Broadly speaking, the effect aimed at by the pretreatment can advantageously be obtained by hydrotreating type processes which are well known in the petroleum and petrochemical industries and consist in a treatment performed under hydrogen pressure in the presence of specific catalysts, the main function of which is to destroy sulphur (and possibly nitrogen or oxygen) containing compounds of the feedstock. In practice, a treatment of this type is always accompanied by a more or less destructive hydrogenation which can be enhanced if necessary by the use of catalysts having a more pronounced hydrogenating or hydrocracking character.

The catalysts most commonly employed in these methods usually have a base of cobalt and/or molybdenum but can also contain or else have a base of other metals such as nickel, tungsten, chromium, iron and so forth. The equilibrium between the desulphurizing activity and the hydrogenating or hydrocracking activity of the catalyst depends not only on the base metals but also on the support (alumina, silica-alumina or molecular sieve).

There consequently exists a wide latitude in the choice of catalysts which can be employed for the hydrogenating pretreatment proposed by the present invention in conjunction with the hydropyrolysis process. The catalysts containing in particular cobalt and molybdenum are recommended when heavy sulphurized feedstocks are employed and when importance is attached to the desulphurization aspect.

Within the field of application of the present invention, these catalysts will preferably be employed under operating conditions which are compatible with the hydrogen/feedstock ratios and pressures required for the hydropyrolysis reaction. This will accordingly make it possible to combine the two operations by interposing the hydrogenating pretreatment on the path of the reaction mixture which is fed to the hydropyrolysis reactor.

This combination is wholly feasible and constitutes an original and particularly advantageous feature of the present invention.

In fact, in comparison with a processing scheme comprising a hydro-treatment of the feedstock which is independent of the hydropyrolysis operation, the proposed combination makes it possible to dispense with preheating of the reactants of the hydro-treatment, with condensation and separation of the effluents and also with the hydrogen cycle which forms part of this operation, together with all the costs involved in purification and compression. This results in substantial savings both in capital investment and in power consumption.

In practice, the pretreatment reactor will be placed in the preheating/vaporization circuit of the hydropyrolysis reactor at a point at which the temperature attains the level required for the hydrogenating treatment which is contemplated. This temperature is a function not only of the catalysts but also of the degree of lightening and desulphurization which are contemplated and can be within the range of 300° C. to 600° C. and preferably 350° C. to 500° C.

At the outlet of the pretreatment reactor, the products (which are still under pressure and contain excess hydrogen) are re-introduced into the preheating/vaporization circuit feeding the hydropyrolysis reactor. Because of the exothermic character of the hydrogenation-desulphurisation reactions, the temperature of these effluents is usually a few tens of degrees higher than the temperature at the inlet of the pretreatment reactor.

In general, the addition of a pretreatment of this type to the hydropyrolysis process does not modify the characteristics of this latter in any respect whatever. The operating conditions and modes of application of this method as described and claimed in the patents cited earlier remain unchanged.

In particular, it remains essential to ensure that the residence time in the thermal hydrocracking reactor is very short. In practice, said residence time is shorter than 0.5 second and preferably below 0.1 second. Since a reduction of the residence time is accompanied by a drop in conversion, this unfavorable effect is compensated if necessary by the adoption of higher temperatures.

These temperatures are capable of varying over a wide range according to the aim of the operation and the duration of the reaction, the temperature at the reactor outlet being within a useful range of 625° to 1000° C.

The pressure at the reactor outlet is maintained between 10 and 70 bars and preferably between 10 and 45 bars.

In regard to hydrogen dilution, the quantities employed must be such that the molar concentration of hydrogen in the effluents from the reactor is at least equal to 20%. High values of this concentration are favorable from the point of view of overall conversion and as a means for preventing the formation of coke-generating tarry products. At the same time, however, such high values have the effect of increasing the tendency towards hydrogenation of the intermediate olefinic products as well as increasing the volume of circulating gases and the costs of separation and recycling of hydrogen. A compromise must therefore be found in each particular case.

In the applications contemplated by the invention, purity of the hydrogen employed is by no means an essential requirement. In regard to the hydropyrolysis operation proper, there is no objection to the presence of other components in the hydrogenating gas provided that these latter are inert with respect to hydrocarbons and to the hydrogen itself under the operating conditions used or at least that they do not produce any undesirable reactions. This is the case in particular with hydrocarbons ($CH_3$, $C_2H_6$, $C_2H_4$, $C_3H_8$ and so forth), carbon oxides (CO and $CO_2$), nitrogen, steam, small quantities of hydrogen sulphide and so on. Some of these compounds can even be added for a well-defined purpose such as the light hydrocrackable hydrocarbons, water vapor or any other diluents.

It should nevertheless be ensured that the hydrogen impurities are not liable to poison the pretreatment catalyst which is chosen or to impair the performances of this operation.

Taking into account the pressure drops and depending on the pressure at the outlet of the hydropyrolysis reactor, the pressure at the inlet of the pretreatment reactor can vary between 12 and 85 bars and preferably between 15 and 55 bars.

The hydrogen/feedstock ratios normally utilized for hydropyrolysis are wholly sufficient for the pretreatment in the majority of instances and this is in principle a favorable circumstance. However, if these ratios are considered too high for practical reasons, part of the hydrogen (or of the gas mixture having a high hydrogen content) can be introduced downstream of the pretreatment reactor. If so required, there can also be introduced downstream of said reactor certain reactants (such as ethane, propane or other recycled fractions) or possible diluents such as steam if it is preferred to avoid their flowing through the catalyst.

Under the temperature and pressure conditions of the hydrogenating pretreatment, the reaction mixture normally comprises a condensed phase and it is a recommended practice to adopt a downward direction of flow in order to ensure correct streaming of said phase through the catalyst bed.

The residence time in said bed is dependent on the type of catalyst which is chosen, on the performances which are contemplated and on the other operating conditions. In general, good results are obtained when the volume flow-rate of the liquid feedstock with respect to the volume of catalyst is within the range of 0.5 to 3 volumes per volume of catalyst and per hour.

The hydrogen consumption due to the pretreatment can vary in a wide range. However, the overall consumption between pretreatment and hydropyrolysis is not appreciably modified in respect of a given type of feedstock and a given severity of hydropyrolysis since the increase in the hydrogen/carbon ratio resulting from the pretreatment reduces the hydrogen consumption at the hydropyrolysis stage to a practically equivalent extent.

Finally, the present invention consists in decomposing and performing the cracking under hydrogen pressure in two steps. The first step is carried out under relatively more moderate temperature conditions and in the presence of a catalyst in order to obtain specific effects so that substantially improved performances are achieved in the subsequent step, namely the hydropyrolysis operation proper.

The accompanying FIG. 1 is a diagrammatic presentation which shows by way of indication the procedure adopted in order to permit insertion of the hydrogenating pretreatment in a unit for the production of olefins which utilizes the hydropyrolysis process.

In this diagram, the preheating/vaporization coil 2*a* receives the feedstock which has previously been brought to the requisite pressure by the pump 1, then mixed at 8 with hydrogen or recycled hydrogenating gas and if necessary at 9 with the recycled products derived from the unit 5.

At the outlet of the coil 2*a*, the reactants which have been brought to the requisite temperature for the hydrogenating pretreatment pass into the hydro-treatment reactor 3. On the downstream side of said reactor, the reactants return into the section 2*b* of the preheating-/vaporization coil before passing into the hydropyrolysis reactor 4.

At the outlet of the hydropyrolysis furnace, the hot cracked products may undergo quenching at 12 by injection either of condensates or of recycled quenching oil before being subjected at 5 to the various treatment involving separation, purification or others which are inherent to this type of operation.

The hydrogen or the hydrogen containing gas 13 derived from this section is recycled, if necessary after adding make-up hydrogen at 14 and compression at 6. Part of this hydrogen can be recycled at 10 at the exit of the hydrogenating pretreatment.

The liquid or gas fractions which have to be reprocessed are discharged as shown diagrammatically at 11 and are either recycled at 9 and/or 10 or re-cracked separately at 7 within an auxiliary hydropyrolysis reactor in the case of certain liquid fractions.

The example given hereinafter by way of indication but not in any limiting sense illustrates the advantage offered by the combination of hydro-treatment and hydropyrolysis in accordance with the present invention.

The feedstock employed is a vacuum gas-oil (VGO) having the following characteristics:

Specific weight at 15° C.: 0.904
Hydrogen content: 12.48%
Sulphur content: 1.95%
Distillation range calculated at 760 mm Hg:

| | |
|---|---|
| I.P. | 233° C. |
| 10% | 335" |
| 20% | 361" |
| 50% | 416" |
| 80% | 447" |
| 90% | 470" |
| E.P. | 502" |
| Residue | 2% |

As can be noted from the foregoing, said feedstock is a very heavy raw material which is considered as particularly unsuitable for the production of light olefins.

Table 1 below summarizes the operating conditions and results obtained at 840° C. without and with pretreatment as well as those obtained at 870° C. with pretreatment.

The catalyst employed for the pretreatment is a cobalt/molybdenum catalyst containing 3% CoO and 15% $MoO_3$. A degree of desulphurization of approximately 80% is obtained under the operating conditions which have been indicated but which are not given in any sense by way of limitation.

It is observed that the sum $C_2H_4+C_2H_6$ which is 29.8% without pretreatment increases to 31.4% with pretreatment when the temperature is 840° C. at the outlet of the hydropyrolysis reactor and attains 34.8% at 870° C.

It should be noted that, when the VGO has not been subjected to a hydrogenating pretreatment, it becomes a difficult matter to carry out the hydropyrolysis operation above 840°-850° C. as a result of an increased coking tendency whereas the difficulties are considerably reduced at 870° C. when the same feedstock is hydrotreated.

The pretreatment has the further effect of reducing the quantity of heavy residue (fraction higher than 200° C.) which decreases from 22.1% to 19.9% when the reactor outlet temperature is 840° C. and even to 19.2% when the reactor outlet temperature is 870° C.

TABLE I

| | without pretreatment | with pretreatment | |
|---|---|---|---|
| Operating conditions | 1 | 2 | 3 |
| 1 Pretreatment: | | | |
| Mean temperature °C. | — | 430 | |
| Gauge pressure at reactor outlet (bars) | — | 30 | |
| Ratio $H_2$/VGO, N $m^3/m^3$ | — | 1,380 | |
| Flow rate, $m^3$ VGO/$m^3$ catalyst/hour | | 1.05 | |
| 2 Thermal hydrocracking | | | |
| Temperature at reactor inlet, °C. | 600 | 600 | 600 |
| Temperature at reactor outlet, °C. | 840 | 840 | 870 |
| Gauge pressure at reactor outlet (bars) | 20 | 20 | 20 |
| Residence time between 600° C. and outlet, sec. | 0.059 | 0.059 | 0.060 |
| Dilution $H_2O$/VGO, weight % | 30 | — | — |
| Weight balance, % kg | | | |
| $CH_4$ | 16.7 | 16.9 | 20.0 |
| $C_2H_4$ | 11.9 | 12.2 | 13.4 |

TABLE I-continued

| | without pretreatment | with pretreatment | |
|---|---|---|---|
| $C_2H_6$ | 17.9 | 19.2 | 21.4 |
| $C_3H_6$ | 10.1 | 9.1 | 7.8 |
| $C_3H_8$ | 3.9 | 3.5 | 2.5 |
| $C_4$ | 2.5 | 2.4 | 1.5 |
| Cracked gasoline ≦200° C. | 16.0 | 17.0 | 15.0 |
| Residue >200° C. | 22.1 | 19. | 19.2 |
| $H_2S$ | 0.6 | 1.6 | 1.6 |
| Sulphur remaining in the liquid fractions (approx) | 1.4 | 0.4 | 0.4 |
| $H_2$ consumption (after deduction of the hydrogen produced by cracking of $C_2H_6$ and $C_3H_8$) N $m^3/t$ | 190 | 202 | 269 |

We claim:

1. A continuous process whereby a hydrocarbon feedstock is subjected to thermal cracking under pressure and in the presence of hydrogen to convert said feedstock to products of lower molecular weight containing high proportions of olefinic components, wherein said method comprises the steps of:

(a) conducting a catalytic hydrogenating pretreatment at a temperature from about 300° and 600° C. and a pressure from about 12 to 85 bars to modify the molecular structures of the feedstock, to lighten the feedstock and to desulphurize said feedstock, said pretreatment being conducted in a catalytic reactor interposed in a preheating/vaporization circuit of the thermal cracking process proper; and immediately thereafter;

(b) conducting a thermal cracking treatment of the pretreated feedstock in the presence of hydrogen and the absence of steam under a pressure from about 10 to 70 bars with a residence time of less than 0.5 second and at a temperature from about 625° C. to 1,000° C., the quantity of hydrogen employed being such that its molar concentration in the effluents is at least equal to 20%.

2. A process according to claim 1, wherein the hydrogen present in the treated hydrocarbon feedstock contains inert components, components which do not give rise to undersirable reactions or mixtures thereof.

3. A process according to claim 1, wherein said method further comprises recycling at least a portion of coproducts from the thermal cracking step to the pretreatment step.

4. A process according to claim 1, wherein at least a portion of the hydrogen is introduced between the hydrogenating pretreatment step and thermal cracking step, together with at least a portion of other reactants.

5. A process according to claim 1, wherein said process is applied to petroleum distillates containing high proportions of sulphur.

* * * * *